United States Patent [19]

Sanchez-Caldera et al.

[11] Patent Number: 4,890,662

[45] Date of Patent: Jan. 2, 1990

[54] MIXING AND COOLING TECHNIQUES

[75] Inventors: Luis E. Sanchez-Caldera, Hudson; Arthur K. Lee, Clinton; Nam P. Suh, Sudbury; Jung-Hoon Chun, Hopedale, all of Mass.

[73] Assignee: Sutek Corporation, Hudson, Mass.

[21] Appl. No.: 219,317

[22] Filed: Jul. 15, 1988

[51] Int. Cl.[4] ..... B22D 11/10

[52] U.S. Cl. ..... 164/46; 164/91; 164/461; 164/113; 164/133; 164/337; 164/423; 164/463; 264/11; 425/7

[58] Field of Search ..... 164/135, 133, 113, 306, 164/312, 284, 46, 461, 91, 463, 423, 337; 264/11, 299, 12; 425/6, 7

[56] References Cited

U.S. PATENT DOCUMENTS 4,278,622 7/1981 Suh ..... 264/463
4,279,843 7/1981 Suh ..... 264/463
4,617,982 10/1986 Tanimura et al. ..... 164/463
4,706,730 11/1987 Sanchez-Caldera etal. ..... 264/463

*Primary Examiner*—Richard K. Seidel
*Attorney, Agent, or Firm*—Robert F. O'Connell

[57] ABSTRACT

A method and system for forming a composite mixture of at least two materials, at least one of which is a metal or metal alloy. The materials in a molten state are supplied via inlet channels to a mixing region so as to indirectly impinge on each other and then to flow through an outlet channel to a cooling system, such as a casting or mold device or a device for providing rapid solidification thereof. The ratio of the cross-sectional area of the outlet channel to the sum of the cross-sectional areas of the inlet channels is arranged to be less than 32 and the ratio of the distance from the input side of the outlet channel to the input of the cooling system to the diameter of the outlet channel is arranged to be greater than 5.

18 Claims, 3 Drawing Sheets

MIXING AND COOLING TECHNIQUES

INTRODUCTION

This invention relates generally to processes and systems for mixing and casting metals, metal alloys, and metal composites and, more particularly, to processes and systems using mixing chambers having specified design characteristics, which can permit the chamber to be readily coupled to various types of casting devices to produce homogeneous metallic composites having a wide range of desirable microstructures.

BACKGROUND OF THE INVENTION

U.S. Pat. Nos. 4,278,622 and 4,279,843, issued on July 14, 1981 and July 21, 1981 to Nam P. Suh, describe a process that has become generally known as the "mixalloy process". Such process involves the mixing of materials in a molten, or slurry, state to form metallic mixtures by the direct impingement of the materials. While the patents describe such process in general terms, they do not provide details with respect to critical parameters that may be required to ensure completely homogeneous mixing, nor do they disclose specific information on any suitable techniques for using the process to cast the materials while preserving the homogeneous characteristics of the mixtures thereof.

Subsequent U.S. Pat. No. 4,706,730, issued on Nov. 17, 1987 to Luis E. Sanchez-Caldera et al., discloses a modification in the mixalloy process technique using an indirect impingement method. Such patent discloses that instabilities (i.e., variations of mixing quality) can be minimized, and even substantially eliminated, if, instead of using a head-on or direct collision or impingement of the impinging streams, the impingement angle is modified so as to induce oblique impingement. The term "instabilities" as used herein refers to variations of mixing quality due to changes, as a function of time, of the flow rates of the materials arriving at the mixing chamber.

It has been determined that, although such modification is necessary to prevent instabilities, the use of indirect impingement techniques does not always ensure a truly homogeneous mixing of the materials involved. For example, if the impinging streams include constituents that require a chemical reaction with each other upon mixing, it is possible that indirect impingement alone will not always provide adequate mixing to ensure that all the reactants will fully react with each other, even though stoichiometry is maintained locally.

Further, although the two earlier issued patents mentioned above also make reference to the need to cool the mixture rapidly enough to preserve the microstructure of the mixture, neither patent describes any specific techniques for actually carrying out the required cooling. Later issued U.S. Pat. No. 4,706,730, on the other hand, makes reference to cooling by making use of a mold or a die caster machine. Generally, the highest cooling rates achieved by the latter are only of the order of magnitude of about 100° C./second (s.) and such a cooling rate may not be fast enough when processing certain types of metallic composites.

It is desirable to devise an appropriate method and system that ensures both a complete mixing of materials in a molten state and a sufficiently rapid cooling rate during the cooling thereof, i.e., a cooling rate of greater than 100° C./s.

BRIEF SUMMARY OF THE INVENTION

A mixing and casting system according to the invention includes a materials injection section which supplies molten, or slurry, materials to be mixed, at least one of which is a metal or metal alloy, through separate channels to a mixing region, sometimes referred to as the mixing chamber. The materials are supplied to the mixing region substantially simultaneously under pressure in a manner such that the materials indirectly impinge upon each other so as to cause the material to form a mixture thereof. The term "indirect impingement", as used herein, is used in the sense as discussed in the aforesaid U.S. Pat. No. 4,706,730.

The mixing region provides communication from the inlet passages to the outlet passage, the passages being arranged so that, in order to achieve a desired complete mixing operation, the ratio of the cross-sectional area of the outlet passage to total cross-sectional area of the inlet passages is selected to be less than specified value. Thus, the ratio ($A_o/A_i$) is selected to be less than about 32, where Ao is the outlet passage cross-sectional area and $A_i$ is the total cross-sectional area, i.e., the sum of the cross-sectional areas, of all of the inlet passages.

In addition, the length L, and the diameter D, of the outlet passage, before substantial cooling takes place, must be such that the ratio L/D thereof in such outlet passage is greater than about 5. The optimum length of L itself, however, is a function of the nature of the materials to be processed and the microstructure of the mixture that is desired and, within such limitation, can be best determined empirically for a particular application.

The term "substantial cooling", as used herein, is described in more detail below. For example, casting equipment capable of achieving cooling rates greater than 100° C./s can be used in direct communication with the outlet passage from the mixing chamber. Such approach provides means for coupling the mixalloy process to a process for rapid solidification, such as by atomization techniques (using water or gas) by using chilled block metal spinning techniques, or any other solidification technique, or even combinations thereof, to achieve a cooling rate higher than 100° C./s. Such high cooling rates are needed in the processing of certain kinds of metallic composites as also discussed in more detail below.

DESCRIPTION OF THE INVENTION

The invention can be described in more detail with the help of the accompanying drawings wherein.

Figure 4:
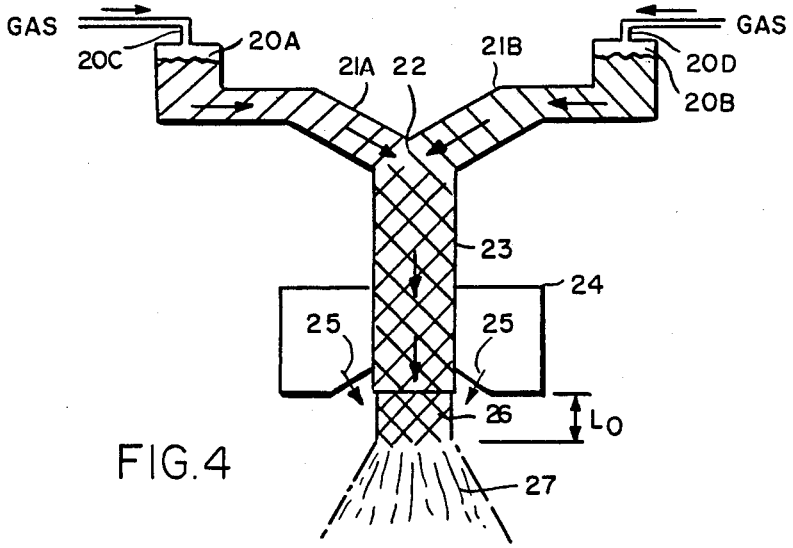
Figure 5:
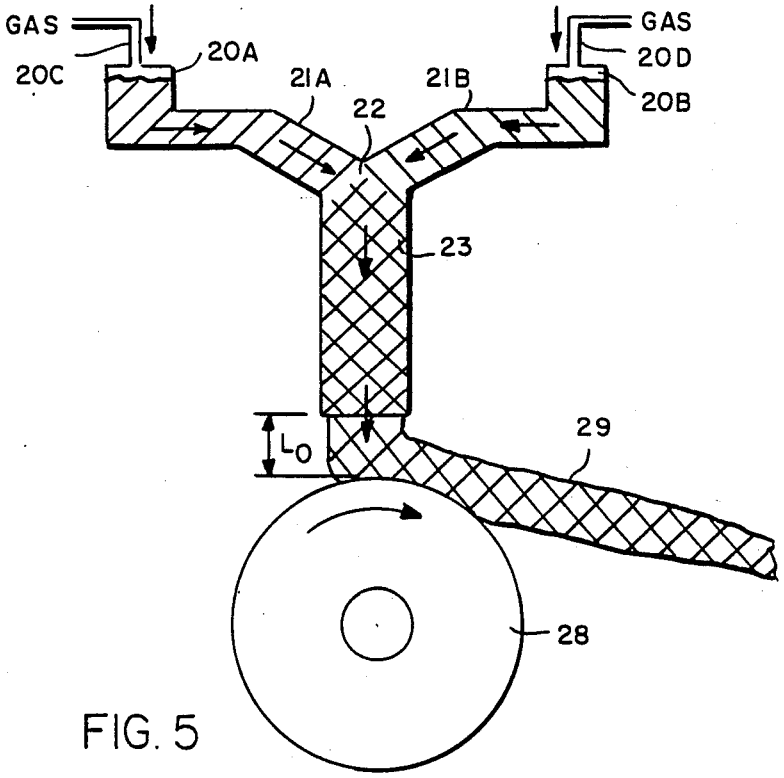

FIGS. 4 and 5 diagramatically show side views of particular systems which represent further exemplary embodiments of the invention. As mentioned above, the invention relates to the mixing of materials, at least one of which is, or includes, a metal or a metal alloy. In some cases, the mixing of such materials can, upon mixing, induce certain or all of the constituents of the mixture to chemically react. The ultimate goal of the mixing process is to produce a metallic composite. In accordance with the term as used in the aforesaid U.S. Pat. No. 4,706,730, a metallic composite is defined as a material which comprises a metal, or metal alloy, matrix to which an additional phase is added. The additional phase, for example, can be a plastic, such as a polymer, a ceramic, a glass, or another metal or metal alloy which is immiscible with the matrix metal or metal alloy.

Figure 1:
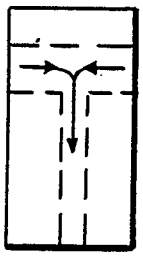
FIG.1 PRIOR ART
FIG. 1 and FIGS. 2A to 2D show diagramatically techniques for mixing materials in accordance with the prior art.

As described in U.S. Pat. No. 4,706,730, it has been concluded that a head-on impingement technique as diagramatically shown in FIG. 1 is a potential source of instabilities, and can even be a cause of total run failure. For this reason, an indirect, or oblique, impingement technique was developed, as discussed in such patent and as shown diagramatically here in FIGS. 2A, 2B, 2C and 2D. It has been found, however, that in using such an indirect impingement approach in some applications, even though instabilities tend to be avoided, such approach can nevertheless sometimes lead to an incomplete mixing of the materials involved.

It has now been found, however, that in accordance with the invention, both an avoidance of instabilities and a complete mixing can be achieved if certain mixing chamber geometrical constraints are satisfied. Not only do such constraints provide a mixing chamber design that ensures complete mixing but, if a chemical reaction is required among some or all constituents of the mixture, the system also ensures that there is enough time for these constituents to so react.

Figure 2A:
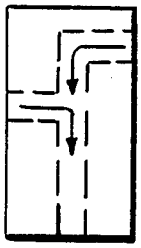
Figure 2B:
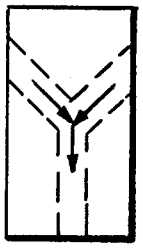
Figure 2C:
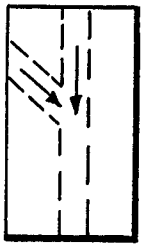
Figure 2D:
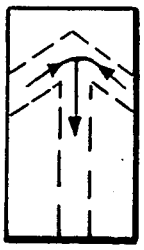
FIG.2D PRIOR ART
Figure 3:
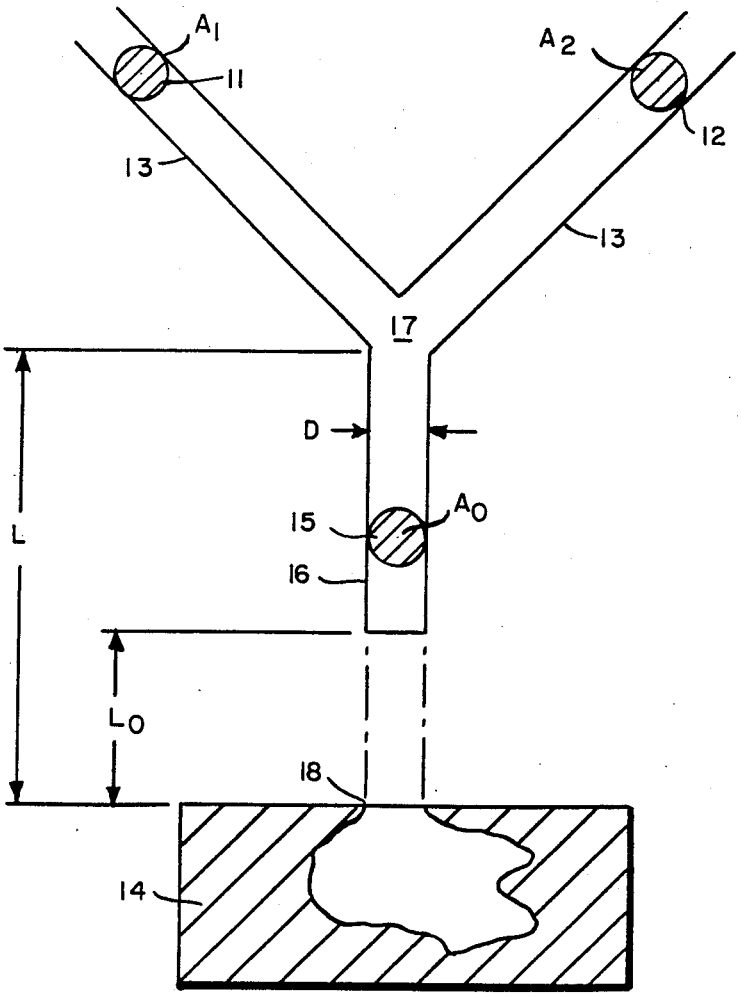
FIG. 3 shows diagramatically a technique for mixing using a mixing chamber in accordance with an exemplary embodiment of the invention.

A particular exemplary embodiment of a mixing process that ensures an avoidance of instabilities and provides a substantially complete mixing is shown in FIG. 3 which uses a specific example of one of the various indirect impingement options, e.g. as shown in FIG. 2B, and further shows diagramatically the important parameters that require critical selection during the design of the mixing chamber. Such parameters, as identified in the particular embodiment of FIG. 3, are:

(1) the sum $A_i$ of the cross-sectional flow areas $A_1$ and $A_2$ (identifiable by reference numerals 11 and 12) of inlet communication passages 13 into a mixing region 17 (i.e., $A_i = A_1 + A_2$);

(2) the cross-sectional area $A_O$ (identifiable by reference numeral 15) of the outlet passage 16 from mixing region 17;

(3) the length L over which mixing and passage of the mixture occurs before substantial external cooling takes place;

(4) the diameter D of the outlet passage 16; and (5) the free flow length $L_o$ (defined more specifically below).

The mixing length, L, is the distance from the input of the outlet passage 16 at the region 17 where impingement and initial mixing of the inlet stream occurs to the point 18 at which external cooling essentially begins to take place, e.g. where final casting of the material takes place, such as at the surface of a mold 14 or, as described later, at a gas or liquid impingement location, or at an interface with a chilled block melt spinner, etc.

It should be pointed out that while the initial mixing occurs in region 17, further mixing of the materials continues to occur in the travel thereof through outlet passage 16. The term free flow length, $L_o$, means the length that the stream of mixed material travels in a substantially unconfined manner from a point 19 at which it leaves the outlet passage 16 (where it has been effectively confined by the passage) to the point 18 where final casting or other external cooling of the material starts to take place.

To achieve a good mixing chamber design, in accordance with the invention, the following relations must hold true. Thus, to allow for sufficient closeness between the mixing streams, the ratio of outlet cross-sectional area $A_O$ to the total inlet cross-sectional area $A_i$ in the embodiment shown is such that $$\frac{A_o}{A_i} < 32 \qquad \text{(Eq. 1)}$$

If the streams are not close enough to each other, i.e., $A_o/A_i > 32$, the materials will not mix satisfactorily regardless of the high degree of turbulence of the streams, since part of the streams will, in effect, never "see each other". On the other hand although it is possible to create a homogeneous mixture with a mixing chamber having a relatively small ratio of $A_o$ to $A_i$, if this ratio is too small, e.g., if it is less than about 0.125, the pressure drop of the mixing operation becomes relatively inefficient. In other words if a system is designed for too low a ratio, a great percentage of the energy required to cause the molten materials to flow would be wasted in overcoming the pressure drop through the outlet passage. Accordingly, it has been found further that such ratio preferably should be within a range from about 0.125 to about 2.0 and, most preferably, it has been found that a ratio of about 0.75 to about 1.5 generally produces the most effective result.

Another important design parameter to consider is the mixing length L as depicted in the system of FIG. 3. It has been found that, if the mixture is cast too rapidly after the streams first impinge upon one another at the mixing region, the cast material tends to produce non-homogeneous microstructures either because the mixing was not complete or, if a chemical reaction is present, a complete reaction of the composite's reacting constituents is not achieved. For this reason it is necessary to design the system in accordance with the following relation.

$$L/D > 5 \qquad \text{(Eq. 2.),}$$

where L and D are as defined above and are shown in the exemplary embodiment of FIG.3.

In many other applications, where the stability of the stream leaving the mixing chamber is of great importance (for example, in cases where very fast cooling rates are required), in addition to the restriction imposed by Eq. 2, it is also desirable to make $L_o$ essentially equal to zero or as close to zero as possible. Since in a practical system it may not be readily possible to reduce $L_o$ to zero, a further relationship in such cases can be expressed as follows: $L_o$ is less than a length at which the free, or unconfined, mixture stream becomes unstable.

In the sense used here the location at which the free stream (i.e., the stream which leaves the outlet passage 16 of the mixing chamber at point 19) becomes unstable is deemed to mean the location at which the previously confined column of fluid that has left the outlet passage 16 of the mixing chamber 14 starts developing corrugations that would ultimately lead to a breakage of the continuously flowing stream into discrete droplets.

However, it should be realized that the above restriction on $L_o$ may not play an important role in those applications where it does not matter whether or not the stream becomes unstable as, for example, in the case of a mixing chamber which is directly linked to a holding tank, or tundish, of a continuous caster. In such a case, the mixing length L in Eq. 2 would be the length of the stream from the impingement region 17 of the mixing region to the beginning of the holding tank, or tundish, of the continuous caster.

The above relationships, as expressed in Eqs. (1) and (2) and in the length $L_o$, can be used for numerous types of mixtures involving metals and metal alloys, as well as metals and metal alloys in combination with glass, polymers and/or ceramics, all of the ingredients being in a molten or slurry state. The mixed (and, if required, chemically reacted) mixture can be supplied from the mixing chamber to a mold, as described, for example, in U.S. Pat. Nos. 4,278,622 and 4,279,843 or to a die caster as disclosed in U.S. Pat. No. 4,786,730. In some cases, the cooling rates achieved by the above techniques may not be sufficiently fast to preserve the very fine microstructure that is the result of high turbulent mixing in a well designed mixing chamber in accordance with the invention. In such cases to prevent an excessive coalescence of particles or an increase in the grain size of the particles, cooling rates faster than 100° C./s may be required. FIGS. 4 and 5 depict exemplary systems utilizing rapid solidification processes (RSP) or techniques, which systems are directly linked to the outlet passage of the mixing chamber. As used herein, the term rapid solidification process, or processes, (RSP), shall mean processes which achieve cooling rates of about 1000° C./s, or greater.

FIG. 4, for example, depicts a system which couples the outlet passage 23 of the mixing chamber to an atomizer nozzle 24. A gas, or liquid such as water, (referred to by arrows 25) can be made to flow at such an angle that it will, upon interaction with the mixture stream of liquid or slurry exiting from the outlet passage 23, cause the stream to break up into solidified powdered particles 27. Since such break up cannot take place right at the exit of the outlet passage of the mixing chamber, the stream remains unbroken for a short distance 26 effectively representing the distance $L_o$. Each powder particle will contain many grains and can be individually considered in itself as a micro-composite material. By using such an approach, much faster cooling rates, of the order of 1000° C./s, or greater, can be achieved.

In the method of FIG. 4, the powders which are so produced can them be pressed, extruded, or otherwise formed, in a conventional secondary operation, to manufacture finished bars, rods, or any other type of product or configuration. Another optional secondary operation using such powders is to deposit them into preforms using spray deposition techniques, for example, from which final products can be made by well-known machining or pressing techniques.

As mentioned above, through the atomization technique illustrated in FIG. 4, fast cooling rates, of the order of 1000° C./s, or more, can be achieved. If even higher cooling rates are required, for example, in order to preserve very unstable conditions achieved during the complete mixing operation at the mixing chamber, other rapid solidification techniques with cooling rates even much greater than 1000° C./s can be used. As an example, FIG. 5 shows a chilled block melt spinning (CBMS) apparatus 28 which is directly linked to the outlet passage 23. In this case, metallic ribbons 29 are produced, such ribbons being the result of cooling rates of the order of as high as 1,000,000° C./s. Again, a short distance from the outlet passage 23 to the chill block represents the length $L_o$.

Materials for mixing can be appropriately supplied to injection sections 20A and 20B of the particular systems discussed about with reference to FIGS. 4 and 5. In sections 20A and 20B heating and melting of relatively solid materials can take place to form molten slurry materials, or material already in a slurry or molten state can be initially so supplied. In particular embodiments such as shown in FIGS. 4 and 5, gas injection means 20C and 20D inject gas, at relatively high pressure, into sections 20A and 20B, respectively. The gas propels the materials in sections 20A and 20B through separate inlet channels 21A and 21B into a mixing region 22 designed in accordance with the relationships expressed in Egs. (1) and (2). In these embodiments $L_o$ is kept to a minimum.

While only a single mixing region is shown in FIGS. 3, 4 and 5, mixing regions 17 and 22 can, if desired, comprise one or more mixing regions as dictated by the specific nature of the material to be manufactured. As seen in the figures, the mixing streams are then cast by either impinging atomized air or water into the molten metal stream (FIG. 4) or by supplying the mixture to a chilled block melt spinner (FIG. 5).

The above techniques for producing a mixing of materials at high turbulence without instabilities and at high cooling rates can lead to the formation of many unique materials. Among these materials are metallic immiscible composites, metallic materials with very small grain size, dispersion strengthened composites formed by the in-situ chemical reaction, and other types of composites which can be obtained by mixing, e.g., slurries containing ceramic particles with metals in a liquid state.

The particular embodiments described above, are not to be considered the only embodiments of the invention and modifications thereof may occur to those in the art within the spirit and scope of the invention. Hence, the invention is not to be construed as limited to the specific embodiments discussed above except as defined by the appended claims.

What is claimed is:

1. A method of forming a composite mixture of at least two materials, at least one of which includes a metal or metal alloys, comprising the steps of (1) providing each of said materials in a molten or slurry state;

(2) causing each of said materials to flow into at least one mixing region through an inlet channel, said materials arriving at said at least one mixing region substantially simultaneously so as to indirectly impinge upon one another to form a composite mixture thereof;

(3) causing said mixture to flow from said at least one mixing region into an outlet channel, the cross-sectional area $A_o$ of said outlet channel and the total cross-sectional area areas $A_i$ of all of said inlet channels, respectively, being selected to have the following relation:

$$\frac{A_o}{A_i} < 32$$

2. A method in accordance with claim 1 and further including the step of (4) supplying the composite mixture from said outlet channel to the input of the cooling system, the outlet channel having a diameter D and a distance L being the distance from the input of said outlet channel at said at least one mixing region to the input of said cooling system, L and D being selected to have the following relation:

$$\frac{L}{D} > 5$$

3. A method in accordance with claim 2 wherein steps (1) through (4) are performed in a substantially continuous operation.

4. A method in accordance with claim 1, wherein said at least two materials are caused to flow at selected velocities and temperatures to permit the materials, or constituents of the materials, to chemically react with each other to form a mixture which includes one or more stable reaction products of said chemical reaction process.

5. A method in accordance with claim 2 wherein the composite mixture is supplied to a casting apparatus for casting said mixture into one or more articles.

6. A method in accordance with claim 5 wherein the composite mixture is supplied to a die caster.

7. A method in accordance with claim 2 wherein the composite mixture is supplied to a holding tank or tundish of a continuous caster.

8. A method in accordance with claim 2 wherein said composite mixture is supplied to a system for providing a rapid solidification process.

9. A method in accordance with claim 8 wherein the composite mixture is supplied to an atomizer for producing powder particles of the composite mixture.

10. A method in accordance with claim 9 and further including the step of forming said powder particles into pre-selected shape.

11. A method in accordance with claim 9 and further including the step of spray depositing said powder particles into a pre-formed shape.

12. A method in accordance with claim 8 wherein the composite mixture is supplied to a chilled block melt spinning apparatus.

13. A method in accordance with claim 1 wherein the ratio $A_o/A_i$ is selected to lie in a range from about 0.125 to about 2.0.

14. A method in accordance with claim 1 wherein the ratio $A_o/A_i$ is selected to lie within a range from about 0.75 to about 1.5.

15. A system for forming a composite mixture of at least two materials, at least one of which includes a metal or a metal alloy, said system comprising a mixing region;

at least two inlet channels for supplying said at least two materials, respectively, substantially simultaneously to said mixing region in a manner such as to cause said at least two materials to indirectly impinge upon one another to form a composite mixture thereof, the sum of the cross-sectional areas of said at least two inlet channels being $A_i$;

an outlet channel having a diameter D for supplying said composite mixture from said mixing region, said outlet channel having a cross-sectional area of $A_o$, the cross-sectional areas $A_i$ and $A_o$ being arranged to have the following relation:

$$\frac{A_o}{A_i} < 32$$

and a cooling system for providing a rapid solidification of the composite mixture directly supplied from said outlet channel to said cooling system in a continuous manner, the input to the cooling system being at a distance L from the input of said outlet channel at said mixing region, the relationship between the diameter D and the distance L being arranged so that $$\frac{L}{D} > 5$$

16. A system in accordance with claim 15 wherein said at least two materials include materials or constituents of articles which chemically react with each other and said materials are supplied by said inlet channels to said mixing region at temperatures and velocities which permit said chemical reaction to occur so that the mixture includes one or more stable reaction products of said chemical reaction process.

17. A system in accordance with claim 15 wherein said cooling system comprises atomizer means for causing an atomized fluid to impinge upon the composite mixture supplied from said outlet channel to cause said mixture to solidify into powered particles of said mixture.

18. A system in accordance with claim 15 wherein said cooling system is a chilled block melt spinning system, the composite mixture being supplied from said outlet channel thereto for solidification of said mixture into solid ribbons thereof.

* * * * *